US006427777B1

(12) United States Patent
Schick

(10) Patent No.: US 6,427,777 B1
(45) Date of Patent: Aug. 6, 2002

(54) MULTILATERAL WELL DRILLING AND REENTRY SYSTEM AND METHOD

(75) Inventor: Robert C. Schick, The Woodlands, TX (US)

(73) Assignee: KMK Trust, The Woodlands, TX (US); Robert C. Schick, sole trustee ( * ) Notice: Subject to any disclaimer, the term of this patent is extended or adjusted under 35 U.S.C. 154(b) by 64 days.

(21) Appl. No.: 09/739,946

(22) Filed: Dec. 18, 2000

(51) Int. Cl.[7] ..... E21B 7/08

(52) U.S. Cl. ..... 166/313; 166/382; 166/384; 166/50; 166/117.6; 175/61

(58) Field of Search ..... 166/313, 381, 166/382, 384, 50, 117, 117.5–117.7; 175/61

(56) References Cited

U.S. PATENT DOCUMENTS

| | | | | |
|---|---|---|---|---|
| 2,839,270 A | | 6/1958 | McCune et al. | |
| 4,304,299 A | | 12/1981 | Holland et al. | 166/255 |
| 4,807,704 A | | 2/1989 | Hsu et al. | 166/313 |
| 5,398,754 A | * | 3/1995 | Dinhoble | |
| 5,467,819 A | * | 11/1995 | Braddick | |
| 5,564,503 A | * | 10/1996 | Longbottom et al. | |
| 5,704,437 A | | 1/1998 | Murray | 175/61 |
| 5,735,350 A | | 4/1998 | Longbottom et al. | 166/313 |

OTHER PUBLICATIONS

FMC Energy Sytems, Fluid Control Division, "Dynetor® Connectors"—Sales Brochure—Internet (Apr. 19, 2000), including Dynetor® Single–Nut Connectors and Dynetor® Doublel–Nut Connectors.

Bowen Unions, Bowen Blanking Plugs, Bowen High–Pressure Unions and Bowen High–Pressure Blanking Plug.

* cited by examiner

*Primary Examiner*—Roger Schoeppel
(74) *Attorney, Agent, or Firm*—William P. Jensen; Shook, Hardy & Bacon L.L.P.

(57) ABSTRACT

A system and method are disclosed for forming and reentering multiple lateral wells through a wall of a common well bore. The system includes an anchor, an orienting member, an extension member, a diverter and a probe releasably connected by one or more unilateral connections and a multilateral connection. The unilateral connection restricts rotational and translational movement of the system upon makeup, and maintains alignment between components thus joined in a single direction. The multilateral connection also restricts rotational and translational movement of the system upon makeup, however, enables alignment between components thus joined in multiple directions. Thus, use of the system enables lateral orientation of the diverter at multiple positions, positioning the diverter at multiple longitudinal positions and selective reentry of each lateral well formed.

40 Claims, 5 Drawing Sheets

FIG. 3
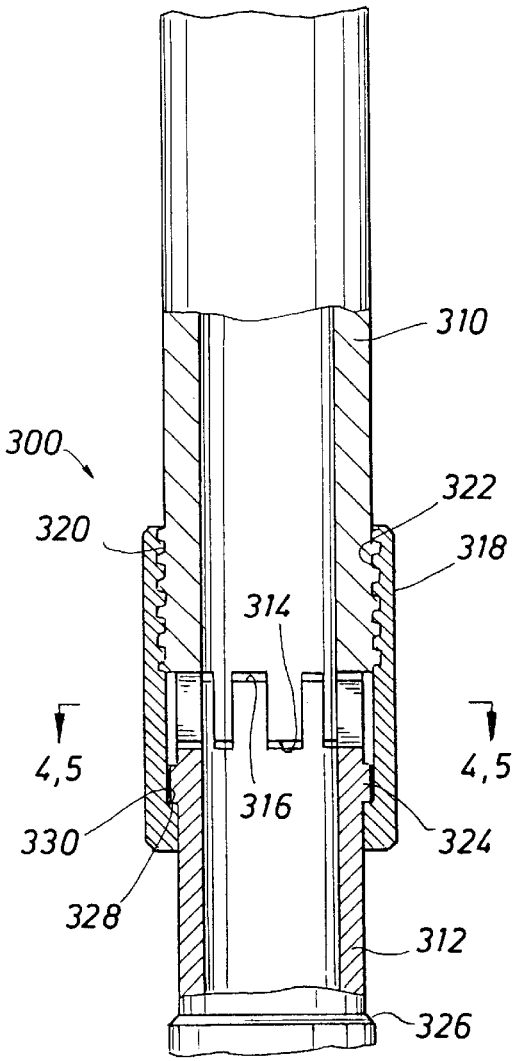
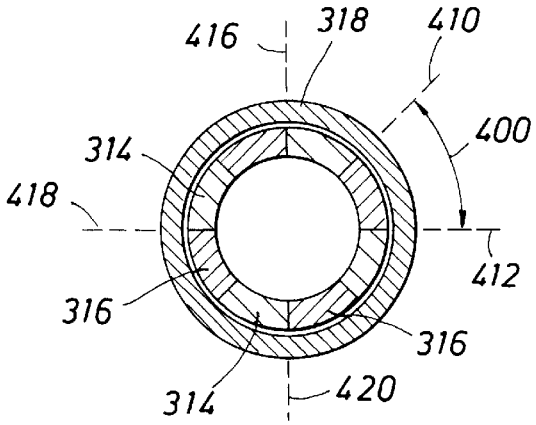
FIG. 4
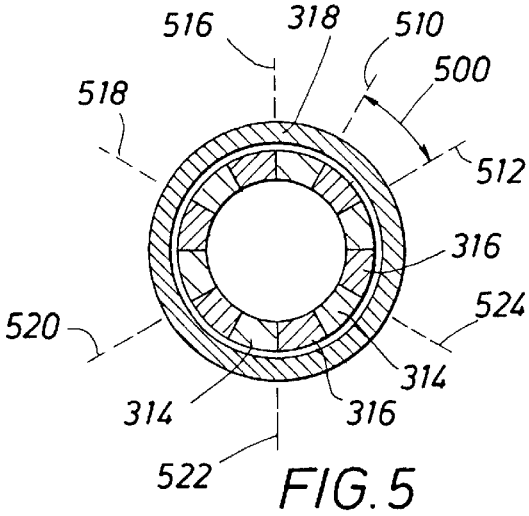
FIG. 5

FIG. 6
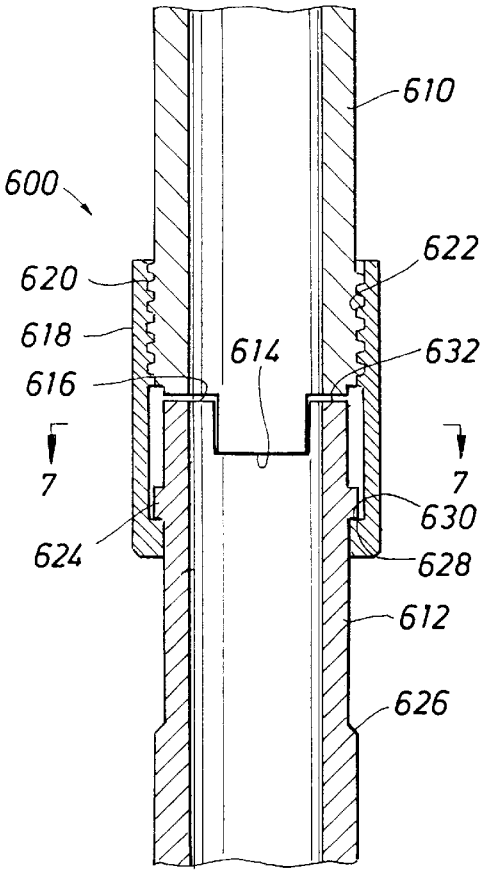
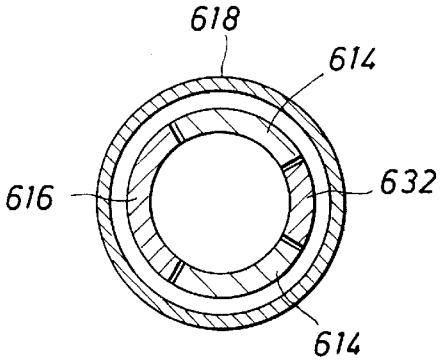
FIG. 7
FIG. 8
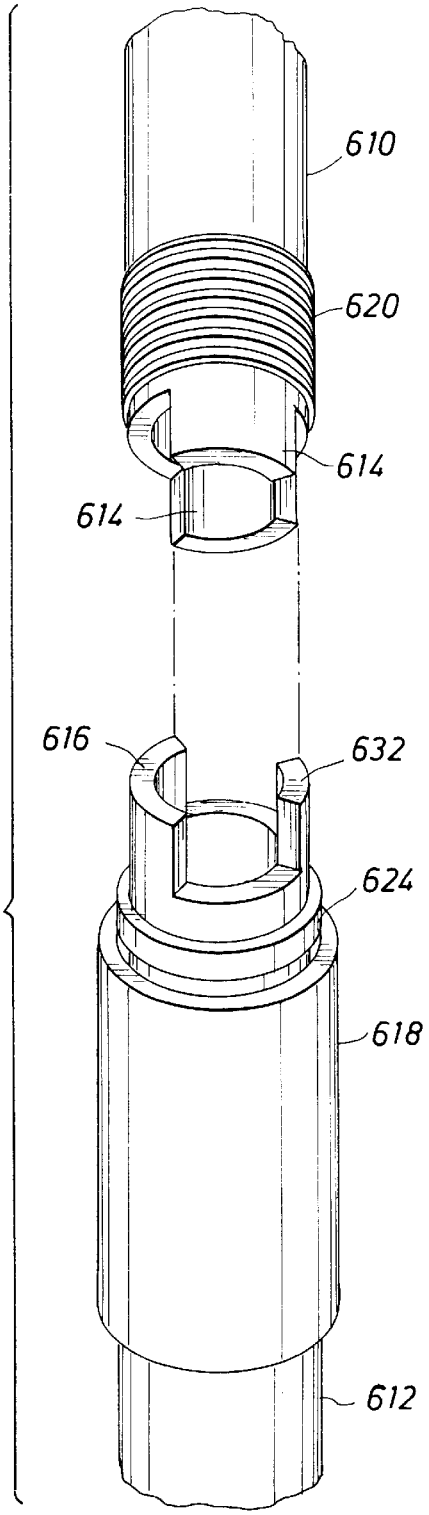

FIG. 11
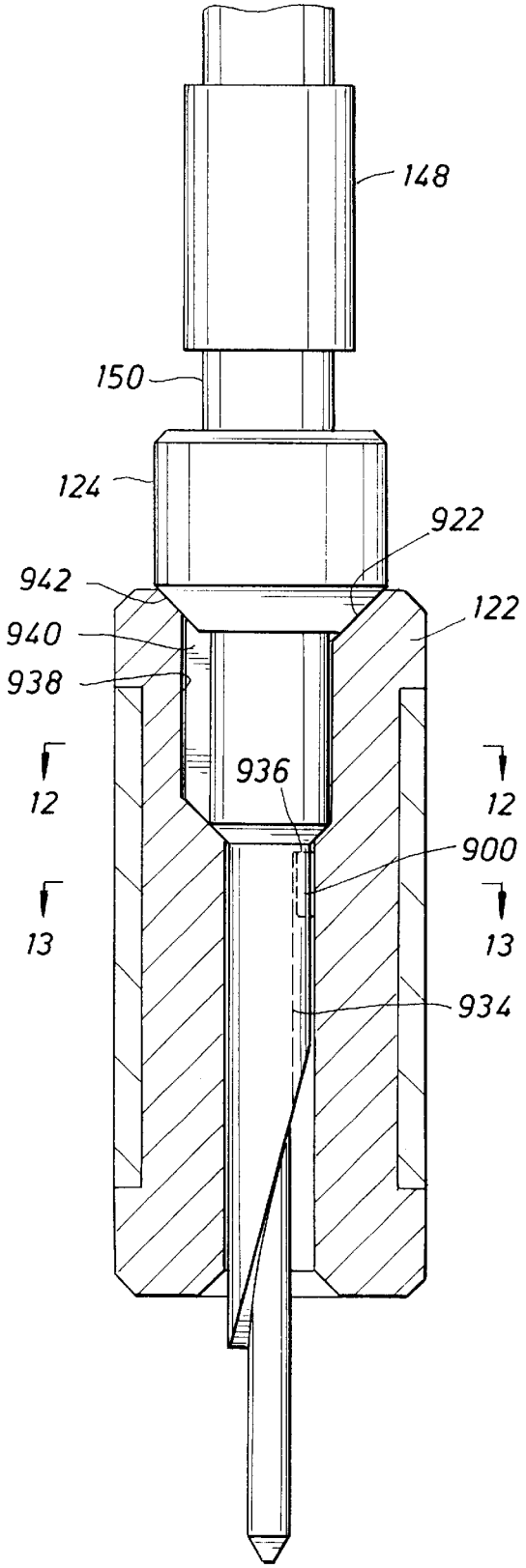
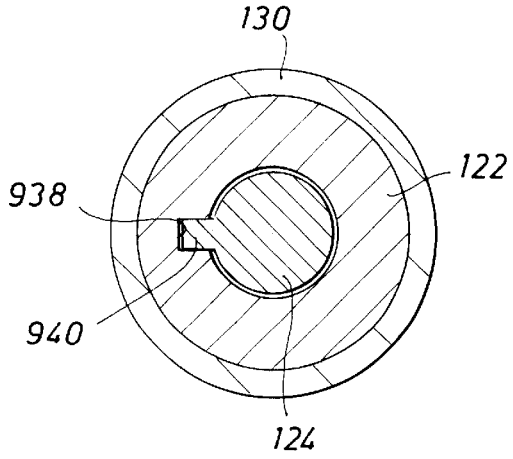
FIG. 12
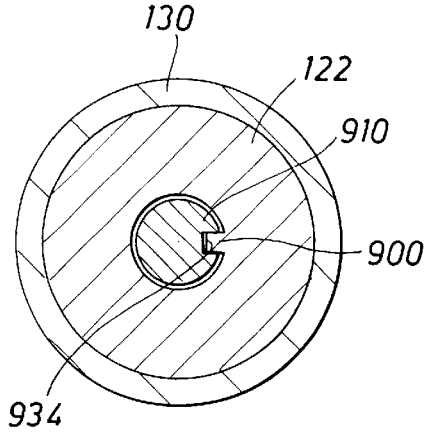
FIG. 13

MULTILATERAL WELL DRILLING AND REENTRY SYSTEM AND METHOD

FIELD OF THE INVENTION

The present invention is directed to a system and method for creating multiple lateral wells through a wall of a common well bore which enables lateral and longitudinal orientation of the system at multiple lateral and longitudinal positions in the common well bore and positive, selective reentry of each lateral well.

BACKGROUND OF THE INVENTION

Several advantages are provided by drilling relatively high angle, deviated or lateral wells from a generally common well bore such as a) access to the regular oil and gas reserves without additional wells being drilled from the surface, b) avoiding unwanted formation fluids, c) penetration of natural vertical fractures, and d) improved production from various types of formations or oil and gas reserves. Additionally, reentry of one or more lateral wells is often required to perform completion work, additional drilling, or remedial and stimulation work. Thus, lateral wells have become commonplace from the standpoint of new drilling operations and reworking existing well bores, including remedial and stimulation work.

Ordinarily, lateral well completion and/or reentry requires expensive downhole wireline surveys to accurately position the diverter or whipstock which is used to direct the boring or completion tool through a wall of a generally vertical well bore into the adjacent formation. Without a survey, the lateral well formed may not be accurately recorded for purposes of reentry. For example, U.S. Pat. Nos. 4,304,299; 4,807,704; and 5,704,437 each describe a method and/or apparatus for producing lateral wells from a generally vertical common well bore using conventional techniques and tools. In each instance, one or more lateral wells may be produced at a different depth and location in the common well bore and reentered. Consequently, the whipstock must be repositioned at the new depth and location. Each time the whipstock is repositioned at a different depth and location, the change in depth and lateral orientation relative to a point of reference is recorded. In most applications using conventional threaded connections as thus described, the exact depth and location of each lateral well formed cannot be accurately or efficiently recreated using the same system and technique. As a result, a downhole directional survey is necessary to relocate the exact depth and location of each lateral well upon reentry.

Recognizing the disadvantages of the foregoing techniques, U.S. Pat. No. 2,839,270 and, more recently, U.S. Pat. No. 5,735,350 have attempted to address the need for a more accurate method and/or apparatus for producing, relocating and reentering lateral wells without the need for a directional survey. For example, U.S. Pat. No. 2,839,270 describes a technique for selectively forming a lateral well through a wall of a common well bore at a predetermined depth and lateral orientation by means of a supporting apparatus which includes apertures formed at predetermined locations in the supporting apparatus. The apertures determine the relative depth and lateral orientation of each lateral well and are prefabricated according to the particular common well bore in which the supporting apparatus is installed. The whipstock is then positioned using one or more specially designed latches which engage a correspondingly designed aperture for receipt of the respective latch.

Similarly, U.S. Pat. No. 5,735,350 describes a method and system for creating lateral wells at preselected positions in a common well bore by means of a diverter assembly having a plurality of locator keys specially designed to engage a corresponding nipple formed in the well bore casing having a unique profile. Although this technique may be employed in new and existing wells, it is expensive and, in some instances, inappropriate because the prefabricated keys and nipples are permanently and integrally formed according to the particular formation characteristics of the common well bore in which the system is installed.

Notwithstanding the conventional attempts at obtaining cost effective and efficient lateral well completion, there is a recognized need for new and improved methods and devices. In particular, there is a need for a cost effective and efficient system and technique for completion of lateral wells which is inexpensive to manufacture, easy to install and may be utilized on new and pre-existing wells. Moreover, there is a need for a technique and system for completion of lateral wells which may be used in a variety of new or preexisting well bores to create and reenter a plurality of different lateral wells without the need for expensive directional surveys or prefabricated equipment.

SUMMARY OF THE INVENTION

It is therefore, a primary object of the present invention to provide a system and method for creating lateral wells through a wall in a common well bore which may be used in new and preexisting well bores to vary the depth and lateral orientation of each lateral well in a cost-efficient and timely manner.

It is another object of the present invention to provide a system and method for creating lateral wells through a wall in a common well bore which may be reinstalled in a particular well bore in order to relocate each lateral well for selective reentry.

It is an advantage of the present invention to provide for the use of conventional and/or standardized equipment in the formation and reentry of multiple lateral wells.

In accordance with the foregoing objects and advantages, the present invention provides an improved system for creating multiple lateral wells through a wall of the common well bore extending from the earth's surface or other point of drilling and completion operations. In accordance with a preferred embodiment, the system comprises an anchor, an orienting member, an extension member, a diverter, and a probe. The anchor includes a packer secured within the common well bore at a predetermined position. The anchor, or packer, also includes a longitudinal reference point and a lateral reference point. The orienting member includes a muleshoe and stinger assembly slidably engaged within the anchor for initial orientation of the system relative to the lateral reference point. The extension member has a first end releasably connected to the orienting member and a second end. The diverter includes a whipstock with an angled or arcuate face which is releasably connected to the second end of the extension member. The probe includes a boring tool which is releasably connected to the diverter for creating a lateral well when the face of the diverter directs the probe toward the wall of the common well bore upon release of the probe from the diverter. This embodiment of the system enables lateral orientation of the diverter at multiple positions relative to the lateral reference point, positioning the diverter at multiple longitudinal positions relative to the longitudinal reference point, and reentry of each of the respective lateral wells created. Each connection between the first end and second end of the extension member and the respective orienting member and diverter restricts rotational and translational movement of each respective connection upon makeup and maintains alignment between the first end and second end of the extension member and the respective orienting member and diverter in a single direction.

In another preferred embodiment wherein the extension member includes one or more segments for positioning the diverter at multiple longitudinal positions, each segment is releasably connected to another respective segment. Each connection between the segments restricts rotational and translational movement of the connection upon makeup. One connection between the plurality of segments enables alignment between the respectively connected segments in multiple directions while the remaining connections maintain alignment between the respective segments in a single direction. The connection enabling alignment in multiple directions is used to laterally orient the diverter in multiple lateral directions and the connection maintaining alignment in a single direction is used to accurately relocate each lateral well upon reentry. One of the plurality of segments closest to the diverter may include another anchor secured within the common well bore for stablizing the diverter.

In another preferred embodiment, the connection of the first end and second end of the extension member to the respective orienting member and diverter restricts rotational and translational movement of each respective connection upon makeup. One connection enables alignment between the extension member and the respective orienting member and diverter in multiple directions, while another connection maintains alignment between the extension member and the respective orienting member and diverter in a single direction. In this embodiment, the extension member may include one or more segments for positioning the diverter at multiple longitudinal positions. Each segment is releasably connected to another respective segment. Each connection between the segments restricts rotational and translational movement of the connection upon makeup and maintains alignment between the plurality of segments in a single direction. The connection enabling alignment in multiple directions is used to laterally orient the diverter in multiple lateral directions while the connection maintaining alignment in a single direction is used to accurately relocate each lateral well upon reentry.

In a preferred embodiment, the lateral reference point includes a key attached to the anchor. The orienting member includes a channel for receipt of the key whereby engagement of the key within the channel enables the initial orientation of the system. The orienting member includes a flange. The anchor includes a channel for receipt of the flange whereby engagement of the flange within the channel prevents rotational movement of the orienting member.

In another preferred embodiment, the present invention provides an improved method for creating multiple lateral wells through a wall of a common well bore using a system of releasably connected components comprising an orienting member, an extension member, a diverter, and a probe. The extension member has a first end releasably connected to the orienting member and a second end releasably connected to the diverter. The orienting member includes a muleshoe and stinger assembly slidably engaged within the anchor for initial orientation of the system relative to the lateral reference point. The diverter includes a whipstock with an angled arcuate face which is releasably connected to the probe. The probe includes a boring tool for creating a lateral well when the face of the diverter directs the probe toward the wall of the common well bore upon release of the probe from the diverter.

The method comprises the steps of a) securing an anchor within the common well bore at a predetermined position, b) lowering the system into the common well bore until the orienting member slidably engages the anchor for initial orientation of the system relative to the lateral reference point, c) releasing the probe from the diverter, and d) creating a lateral well through the wall of the common well bore using the probe. The step of releasing the probe from the diverter may be performed by compressing the system, whereby the probe is released from the diverter upon compression of the system. The step of creating the lateral well with the probe may further comprise one of the steps of milling through the wall of the common well bore and boring into an adjacent formation in the earth. Although creating the lateral well may be performed in a single run in some applications, in most applications the lateral well is created in two separate runs because two different probes are used to mill an opening or "window" in a casing lining the common well bore and drill through the formation. As a result, the probe used to mill must be removed at the surface and replaced with the probe used to drill, thus requiring two separate runs to complete a lateral well.

Reentry of the lateral well comprises the steps of replacing the probe with another probe, lowering the system into the common well bore until the orienting member slidably engages the anchor, and releasing the another probe from the diverter for reentry of the lateral well. The diverter is releasably connected to the another probe and is positioned at the first lateral position and the first longitudinal position.

In this embodiment, the anchor includes a packer secured within the common well bore at a predetermined position. The anchor, or packer, also includes a longitudinal reference point and a lateral reference point. The diverter is positioned at a first lateral position which is aligned with the first lateral reference point and a first longitudinal position located a predetermined distance from the first longitudinal reference point. The orienting member includes a muleshoe and stinger assembly slidably engaged within the anchor for initial orientation of the system relative to the lateral reference point. The diverter includes a whipstock with an angled or arcuate face. The probe includes a boring tool which is releasably connected to the diverter for creating a lateral well when the face of the diverter directs the probe toward the wall of the common well bore upon release of the probe from the diverter. This embodiment of a method for using the system thus described, enables lateral orientation of the diverter at multiple positions relative to the lateral reference point, positioning the diverter at multiple longitudinal positions relative to the longitudinal reference point, and selective reentry of each of the respective lateral wells created.

In a preferred embodiment, the method further comprises the step of performing a directional survey for determining the predetermined position of the anchor. Once the anchor is lowered into the common well bore, a directional survey is performed and the anchor is hydraulically or mechanically secured at a predetermined position.

In another preferred embodiment wherein the extension member includes one or more segments for positioning the diverter in multiple longitudinal positions, each segment is releasably connected to another respective segment. Each connection between the segments restricts rotational and translational movement of the connection upon makeup. One of the segments closest to the diverter may include another anchor for stablizing the diverter, the method further comprising the step of securing the other anchor within the common well bore below the diverter.

In yet another embodiment of the present invention, the method further comprises the steps of a) removing the system from the common well bore upon completion of the lateral well, b) adjusting a length of the extension member, c) positioning the diverter at a second lateral position relative to the lateral reference point, d) lowering the system into the common well bore until the orienting member slidably engages the anchor, e) releasing the probe from the diverter, and f) creating another lateral well through the wall of the common well bore using the probe. The step of removing the system upon completion of the lateral well comprises removing the probe from the common well bore with a drill string connected to the probe and retrieving the orienting member, extension member and diverter from the common well bore with a fishing tool. In this embodiment, the extension member includes a first end and a second end. The first end and second end of the extension member is releasably connected to the respective orienting member and diverter for restricting rotational and translational movement upon makeup. One connection enables alignment between the extension member and the respective orienting member and diverter in multiple directions, while another connection maintains alignment between the extension member and the respective orienting member and diverter in a single direction. The step of adjusting a length of the extension member may include a) removing the extension member and replacing it with another extension member having a different length than the existing extension member, b) simply connecting another extension member to the existing extension member; or c) where the extension member includes a plurality of releasably connected segments, removing one of the segments.

Reentry of the other lateral well comprises the steps of replacing the probe with another probe, lowering the system into the common well bore until the orienting member slidably engages the anchor, and releasing the another probe from the diverter for reentry of the another lateral well. The diverter is releasably connected to the another probe and is positioned at the second lateral position and the second longitudinal position. The diverter is positioned at a second longitudinal position relative to the longitudinal reference point. Thus, the diverter may be positioned to create another lateral well having coordinates corresponding with the second lateral position and second longitudinal position.

In another preferred embodiment, the lateral reference point includes a key attached to the anchor. The orienting member includes a channel for receipt of the key whereby engagement of the key within the channel enables the initial orientation of the system. The orienting member includes a flange. The anchor includes a channel for receipt of the flange whereby engagement of the flange within the channel prevents rotational movement of the orienting member. The diverter includes a whipstock having an angled face.

Although the terms longitudinal and lateral are used herein for convenience, those skilled in the art will recognize that the system and method of the present invention may be employed with respect to wells which extend in directions other than generally vertical or horizontal.

The foregoing has outlined rather broadly the objects and advantages of the present invention so that those skilled in the art may better understand the detailed description of the invention that follows. Additional objects and advantages of the invention will be described below which form the subject the subject of the claims of the invention. Those skilled in the art should appreciate that they may readily use the conception and specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a fuller understanding of the nature of the present invention, reference is made to the following detailed description taken in connection with the accompanying drawings in which:

FIG. 3 is a cross-sectional view of the multilateral connection in FIG. 1.

FIG. 4 is a cross-sectional view of one embodiment of the connection in FIG. 3 along 4—4

FIG. 5 is a cross-sectional view another embodiment of the connection in FIG. 3 along 5—5.

FIG. 6 is a cross-sectional view of the unilateral connection in FIG. 1.

FIG. 7 is a cross-sectional view of one embodiment of the connection in FIG. 6 along 7—7.

FIG. 8 is an exploded view of the connection in FIG. 6.

FIG. 11 is a cross-sectional view of the anchor in seated engagement with the orienting member of FIG. 1.

FIG. 12 is a cross-sectional view of the orienting member flange in engagement with the anchor along 12—12 in FIG. 11.

FIG. 13 is a cross-sectional view of the anchor key in engagement with the orienting member along 13—13 in FIG. 11.

DESCRIPTION OF PREFERRED EMBODIMENTS

Figure 1:
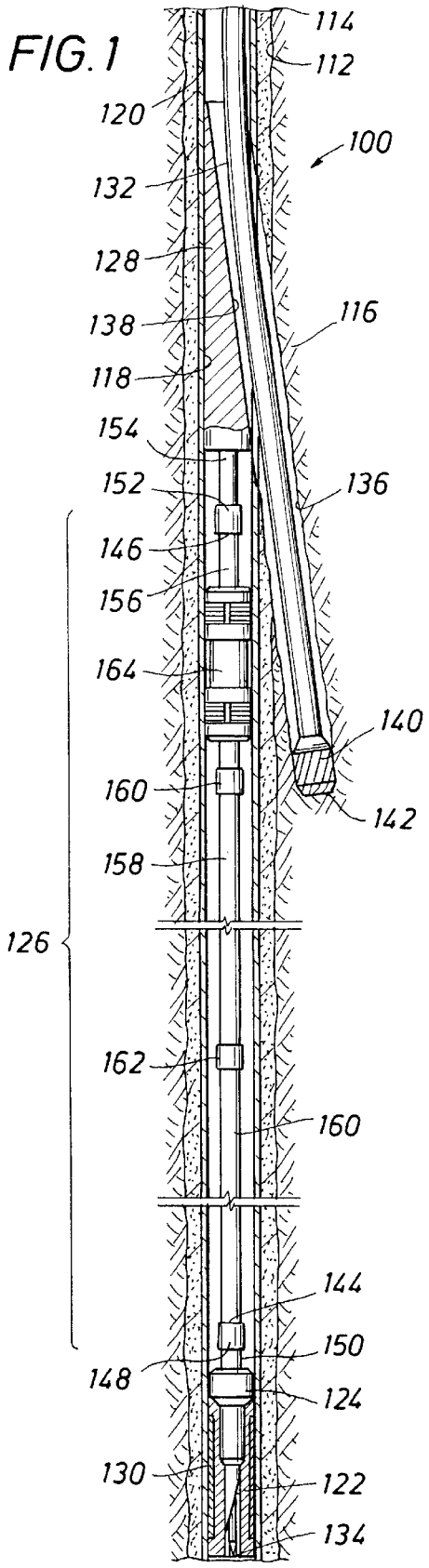
FIG. 1 is an elevational view of one embodiment of the present invention shown in partial cross-section.

In the description which follows, like parts are marked throughout this description and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness.

In FIG. 1, an elevational view of one embodiment of the present invention defining a system 100 is illustrated in partial cross-section. The system 100 may be used in both new and pre-existing well environments and is generally shown within a common or main well bore 112 that has been drilled generally vertically into and through a surface 114 of the earth in a conventional manner. The common well bore 112 extends generally vertically downward into a formation region 116 from which it may also be desired to induce or inject fluids. In the embodiment shown, the common well bore 112 is generally vertical. However, it may extend in other non-vertical directions approaching horizontal. The main casing 118 is set in the common well bore 112 with a cement liner 120 also in a conventional manner.

The system 100 comprises an anchor 122, an orienting member 124, an extension member 126, and a diverter 128. In this illustrated embodiment, the anchor 122 includes a packer of any conventional type which may be secured within the common well bore 112 against casing 118 by a plurality of slips 130 in any conventional manner. The anchor 122 is positioned within the common well bore 112 at a predetermined position using a drill string comprising drill pipe similar to that shown in reference to the drill string 132. The predetermined position of the anchor 122 is determined by conventional survey means such as a directional downhole survey of the formation 116 to determine the depth and lateral orientation of the anchor 112. Once positioned, the anchor 112 includes a longitudinal reference point 134 and a lateral reference point as shown and more particularly described in reference to FIGS. 9, 10 and 11. The anchor 122 is permanently set in most applications and may be modified to include the longitudinal reference point 134 and lateral reference point.

Once the anchor 122 is positioned and set against the casing 118 in the common well bore 112, the orienting member 124, extension member 126, and diverter 128 are lowered into the common well bore 112 until the orienting member 124 is slidably engaged within the anchor 122. In order that a lateral well 136 may be created in a timely and cost-efficient manner, the system 100 may be lowered into position using the drill string 132 in a single run. The drill string 132 may be operatively connected to the diverter 128 by a releasable mechanism such as a shear pin (not shown).

In this embodiment, the diverter 128 includes a whipstock of any conventional type having a face 138 which may be angular or arcuate. The orientation of the face 138 of the diverter 128 is determined by the longitudinal reference point 134 and lateral reference point. Thus, once the orienting member 124 is fully engaged within the anchor 122, the initial orientation of the system 100 and face 138 of the diverter 128 are set and the drill string 132 may be separated from the diverter 128 to create the lateral well 136 using a probe 140 attached to the end of the drill string 132. The probe 140 generally includes a boring bit 142 capable of milling through the casing 118, the cement liner 120 and/or the adjacent formation 116. For purposes of the present invention, the term "boring" is generic and includes the terms "milling" and "drilling". Milling generally refers specifically to the operation of cutting through metal. Drilling generally refers to cutting through non-metal, including earth or other composite materials. As illustrated, the boring bit 142 may include a drilling bit, such as a rock bit, or a milling bit, depending on the application. Although creating the lateral well 136 may be performed in a single run in some applications, in most applications the lateral well is created in two separate runs because two different probes are used to mill an opening or "window" in the casing 118 and drill through the formation 116. As a result, the probe used to mill must be removed at the surface and replaced with a probe used to drill, thus requiring two separate runs to complete a lateral well.

The extension member 126 includes a first end 144 releasably connected to the orienting member 124 and a second end 146 releasably connected to the diverter 128. The connection of the first end 144 and second end 146 of the extension member 126 to the respective orienting member 124 and diverter 128 is preferably a union connection of any conventional type such as "DYNETOR®" "BOYEN®" connectors. A connection 148 of this type is shown joining the first end 144 of the extension member 126 with an end 150 of the orienting member 124 and another connection 152 of the same type is shown joining the second end 146 of the extension member 126 and an end 154 of the diverter 128. Each connection 148, 152 restricts rotational and translational movement of each respective connection upon makeup of the system 100 as more particularly described in reference to FIG. 6.

In the embodiment of the system 100 depicted in FIG. 1, the extension member 126 includes a plurality of segments 156, 158 and 160, which may be manufactured from standard drill pipe and are releasably connected to restrict rotational and translational movement upon makeup using union connections 160, 162. Thus, the diverter 128 and corresponding position of the lateral well 136 may be adjusted relative to the longitudinal reference point 134, depending on the length and number of segments comprising the extension member 126. As shown by the extension member 126, segments 158 and 160 may be uniform in length and/or dimension while segment 156 may be of another different length and/or dimension.

The segment 156 closest to the diverter 128 includes another anchor 164 for stabilizing the diverter 128 as needed when the diverter 128 is positioned a distance from the anchor 122. Accordingly, the greater the distance between the anchor 122 and the diverter 128, the more likely the need for another anchor 164 for stabilizing the diverter 128. The anchor 164 may include any conventional retrievable packer which may be hydraulically or compression set against the casing 118 to stabilize the diverter 128. Alternatively, the diverter 128 may include a releasable packer (not shown) and/or releasable slips (not shown) to stabilize the diverter 128.

Figure 2:
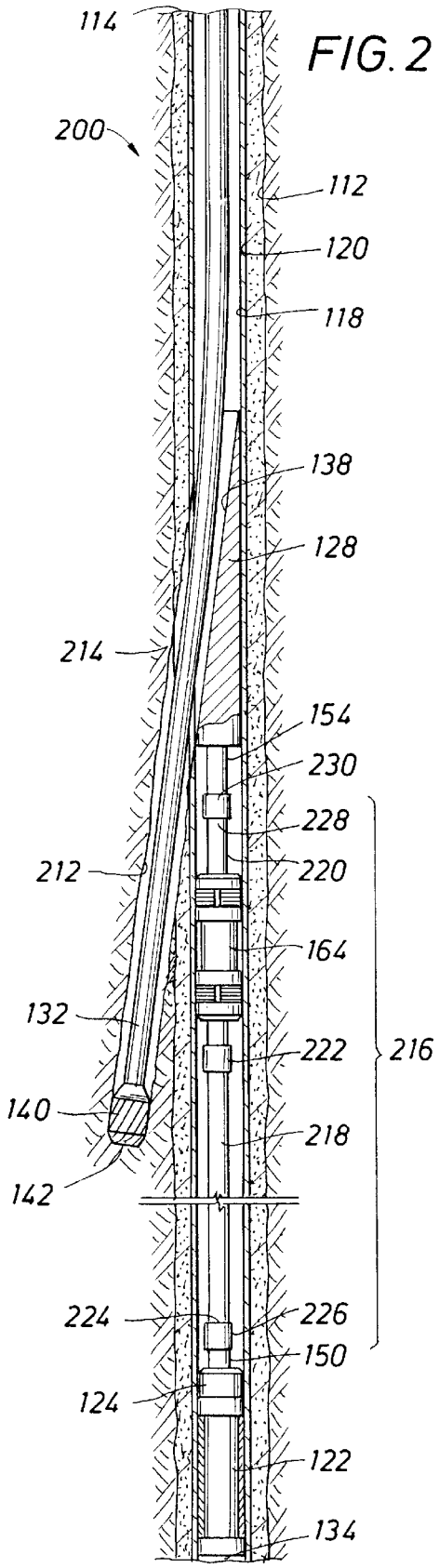
FIG. 2 is an elevational view of another embodiment of the present invention shown in partial cross-section.

Referring now to FIG. 2, an elevational view of another embodiment of the system 200 is shown in partial cross-section. In this embodiment, another lateral well 212 is formed by the probe 140 and boring bit 142 through the common well bore 112, cement liner 120, and casing 118 in an area of the formation 214. In order to maximize drainage and production in the area of formation 214, the lateral well 212 is formed at a different lateral orientation than the lateral well 136 in FIG. 1. In order to further maximize drainage and production in the area of the formation 214 and prevent weakening of the casing 118, the lateral well 212 is formed through the common well bore 112 at a different depth from the longitudinal reference point 134 than the depth used to locate and form the lateral well 136 in FIG. 1.

As shown in FIG. 2, the system 200 comprises the same components comprising the system 100 in FIG. 1, except that the extension member 216 is of a different length and only includes segments 218 and 220. The segments 218 and 220 are releasably connected by a union connection 222 which restricts rotational and translational movement upon makeup. Similarly, the first end 224 of the extension member 216 is releasably connected to an end 150 of the orienting member 124 by a union connection 226 which restricts rotational and translational movement upon makeup. The second end 228 of the extension member 216 is likewise releasably connected to an end 154 of the diverter 128 by a union connection 230 which restricts rotational and translational movement upon makeup.

By comparison of FIGS. 1 and 2, it can be seen that the location and position between lateral wells 136 and 212 is altered to maximize production from the adjacent respective formations 116 and 214. Accordingly, formation of another lateral well at a different depth may be accomplished by removing, replacing and/or adding any segment comprising the extension member in FIG. 1 or FIG. 2.

Referring now to FIG. 3, a cross-sectional view of a multilateral connection 300 is shown. The multilateral connection 300, releasably connects end 310 with end 312 which may be manufactured from most any commercially available drill pipe. Each end 310 and 312 includes equidistantly spaced interlocking teeth 314 and 316, which restrict rotational movement of the multilateral connection 300 upon makeup. A union connection 318 is used to threadibly secure the multilateral connection 300 and prevent translational movement upon makeup. Accordingly, the multilateral connection 300 includes threads 320 which interlock with threads 322 on the connection 318. End 312 includes a shoulder 324 and stop 326. When the multilateral connection 300 is made up, a surface 328 of the shoulder 324 contacts an internal surface 330 of the connection 318, causing end 310 and end 312 to move toward each other until the multilateral connection 300 is completely made up. The stop 326 is used to prevent the connection 318 from sliding past the stop 326 when end 312 is separated from end 310.

The multilateral connection 300 enables ends 310 and 312 to be aligned in multiple lateral directions. Consequently, the diverter 128 in FIGS. 1 and 2 may be positioned in multiple lateral directions in order to form multiple lateral wells as shown in FIGS. 1 and 2. Once made up, however, the connection 318 prevents translational movement of each end 310 and 312 away from each other, and the interlocking teeth 314 and 316 prevent rotational movement of the connection which may compromise the position of the diverter 128 and corresponding lateral well 212. Thus, the multilateral connection 300 enables alignment of end 310 with end 312 in multiple directions and allows accurate reentry of each lateral well 212 formed as further described in reference to FIGS. 4 and 5.

Referring now to FIG. 4, a cross-sectional view of one embodiment of the multilateral connection in FIG. 3 along 4—4 is illustrated. The teeth 314 and 316 are equidistantly spaced in increments of 45° as represented by angle 400 which is formed by the imaginary projection of each side 410 and 412 of a respective tooth. Accordingly, the diverter 128 in FIG. 1 may be laterally oriented to form the lateral well 136 at multiple positions in increments of 90° by rotating the connection before makeup as shown by the imaginary projection of sides 412, 416, 418 and 420. The diverter 128 in FIG. 1 may be initially oriented at any position between the imaginary projection of sides 412, 416, 418 and 420, provided the initial position is recorded.

In FIG. 5, a cross-sectional view of another embodiment of the multilateral connection in FIG. 3 along 5—5 is illustrated. In this embodiment, the interlocking teeth 314 and 316 are equidistantly spaced in increments of 30° as represented by angle 500 which is formed by the imaginary projection of each side 510 and 512 of a respective tooth. Accordingly, the diverter 128 in FIG. 1 may be laterally oriented to form the lateral well 136 at multiple positions in increments of 60° by rotating the connection before makeup as shown by the imaginary projection of sides 512, 516, 518, 520, 522 and 524. In either embodiment described in reference to FIGS. 4 and 5, the teeth comprising the multilateral connection may be equidistantly spaced in different increments, if necessary.

In the embodiment of the system 100 illustrated by FIG. 1, either connection 160 or 162 includes the multilateral connection 300 as described in reference to FIG. 3, for positioning the diverter 128 at multiple lateral positions. In the embodiment of the system 200 illustrated by FIG. 2, either connection 230 or 226 includes the multilateral connection 300 as described in reference to FIG. 3 for positioning the diverter 128 at multiple lateral positions.

Referring now to FIG. 6, a cross-sectional view of a unilateral connection 600 is shown. The unilateral connection 600 releasably connects end 610 with end 612 which may be manufactured from most any commercially available drill pipe. Each end 610 and 612 includes equidistantly spaced interlocking teeth 614 and 616, which restrict rotational movement of the unilateral connection 600 upon makeup. A union connection 618 is used to threadibly secure the unilateral connection 600 and prevent translational movement upon makeup. Accordingly, the unilateral connection 600 includes threads 620 which interlock with threads 622 on the connection 618. End 612 includes a shoulder 624 and stop 626. When the unilateral connection 600 is made up, a surface 628 of the shoulder 624 contacts an internal surface 630 of the connection 618 causing end 610 and end 612 to move toward each other until the unilateral connection 600 is completely made up. The stop 626 is used to prevent the connection 618 from sliding past the stop 626 when end 612 is separated from end 610.

The unilateral connection 600 maintains alignment of each end 610 and 612 in a single lateral direction. In essence, the unilateral connection 600 is self-aligning as described more fully in reference to FIGS. 7 and 8. Once made up, the connection 618 prevents translational movement of each end 610 and 612 away from each other, and the interlocking teeth 614 and 616 prevent any rotational movement of the connection which may compromise the position of the diverter 128 of corresponding lateral well 212. Thus, the unilateral connection 600 maintains alignment of each end 610 and 612 in a single direction for accurate reentry of each lateral well 212 formed.

In FIG. 7, a cross-sectional view of one embodiment of the unilateral connection in FIG. 6 along 7—7 is illustrated. This unilateral connection includes spaced interlocking teeth 614, 616 and 632. At least two teeth 616 and 632 are of a different size and proportion in order that the unilateral connection 600 can be made up in only one lateral direction, thus self-aligning. As shown more particularly in the exploded view of the unilateral connection in FIG. 8, the interlocking teeth 614, 616 and 632 must be aligned in the same manner each time before the connection is made up. Various alternative designs for the interlocking teeth may be used provided that the teeth must be aligned in the same manner each time before the connection is made up. Accordingly, the unilateral connection 600 is used instead of conventional threaded connections in order to maintain consistent alignment between the components comprising the system when reentry of multiple lateral wells is desired.

In the embodiment of the system 100 illustrated in FIG. 1, each connection 148 and 152 includes the unilateral connection 600 as described in reference to FIG. 6. Additionally, either connection 160 or connection 162 includes the unilateral connection 600 as described in reference to FIG. 6, and the other connection 160 or 162 includes the multilateral connection 300 as described in reference to FIG. 3. In this embodiment, lateral wells may be created using the system 100 at different depths and lateral positions through the wall of the common well bore 112. More importantly, however, once the system 100 has been removed from the common well bore 112, the system 100 may be reconstructed to achieve precisely the same longitudinal position and lateral orientation for each lateral well formed without having to conduct costly and time consuming directional surveys and without having to install specially designed casing or other equipment. In the embodiment of the system 200 illustrated in FIG. 2, either connection 226 or 230 includes the multilateral connection 300 as described in reference to FIG. 3, and the other connections 222 and 226 or 230 include the unilateral connection 600 as described in reference to FIG. 6.

Figure 9:
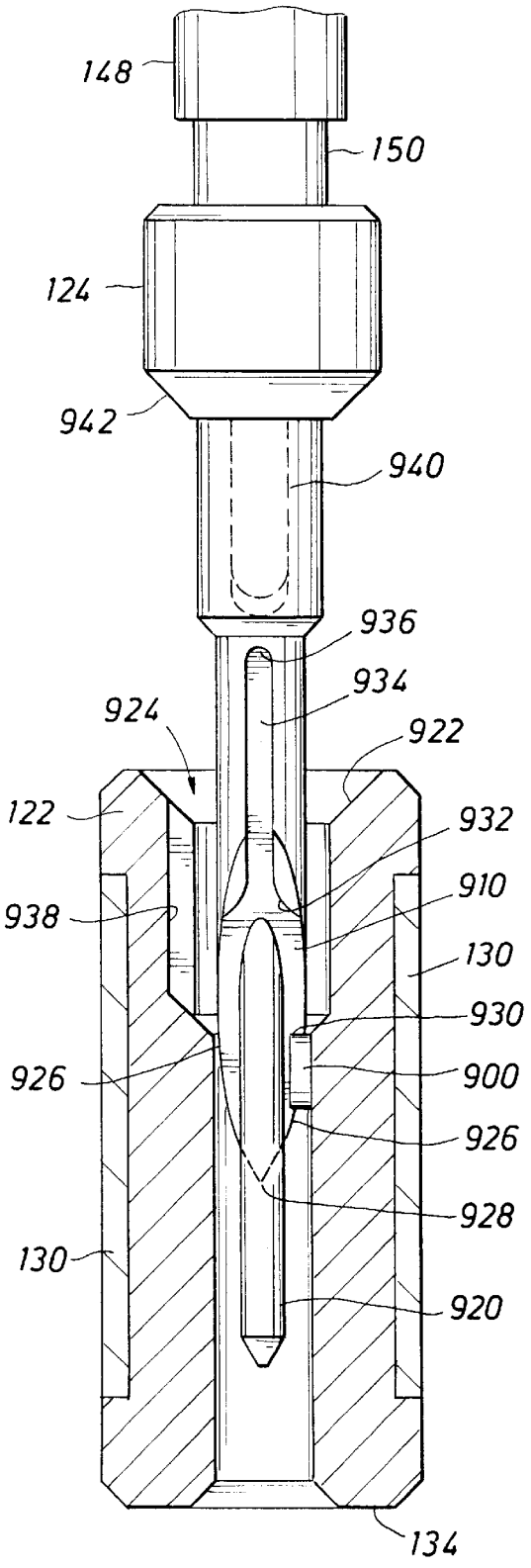
FIG. 9 is a cross-sectional view of the anchor prior to engagement with the orienting member of FIG. 1.

Referring now to FIG. 9, a cross-sectional view of the anchor 122 shown in FIG. 1 is illustrated prior to engagement with the orienting member 124. Once the anchor 122 is set and slips 130 are activated to contact the casing and secure the anchor 122 within the common well bore 112, the longitudinal reference point 154 and the lateral reference point 900, which includes a key attached to the anchor 122, are set. The orienting member 124 includes a muleshoe 910 and stinger 920 assembly. The stinger 920 is used to stab and locate the anchor 122 in order to initially align the orienting member 124 as it engages the anchor 122. Thus, the stinger 920 may contact seat 922 of anchor 122 causing the stinger 920 to align within the opening of passageway 924 through the anchor 122. The muleshoe 110 includes a curvilinear edge 926 terminating at a pointed tip 928. The curvilinear edge 926 and pointed tip 928 are shaped to guide the muleshoe 910 and orienting member 124 around the lateral reference point or key 900. Thus, if the pointed tip 928 contacts surface 930 on top of the key 900 as the muleshoe 910 enters passageway 924, the muleshoe 910 will rotate to one side of the key 900 freely permitting the muleshoe 910 to traverse the passageway 924 until the key 900 contacts guide surface 932 of channel 934. Once the key 900 contacts guide surface 932, the muleshoe 910 and orienting member 124 is further rotated as shown in reference to FIG. 10 where the key 900 is positioned within channel 934. The channel 934 includes a stop 936. The anchor 122 includes a channel 938 for receipt of flange 940 on the orienting member 124. A shoulder 942 on the orienting member 124 supports the orienting member 124 upon engagement with seat 922 of the anchor 122.

Figure 10:
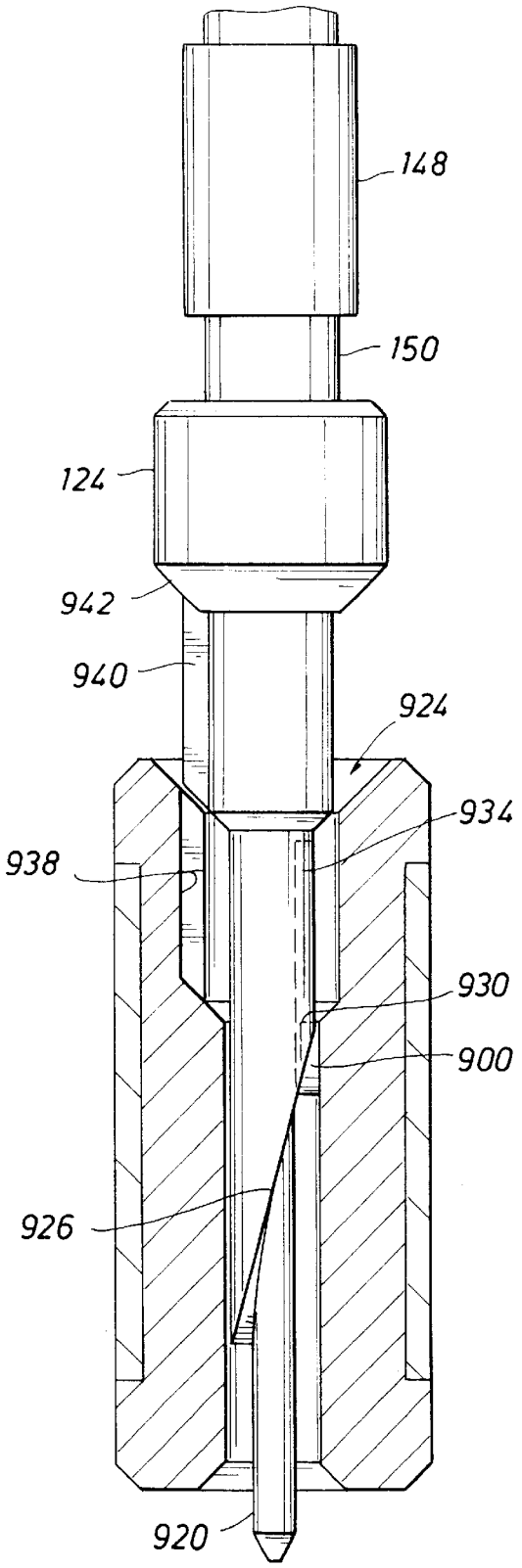
FIG. 10 is a cross-sectional view of the anchor in partial engagement with the orienting member of FIG. 1.

In FIG. 10, a cross-sectional view of the anchor 122 is illustrated in partial engagement with the orienting member 124. The key 900 is positioned in channel 934 of the muleshoe 910 causing the orienting member 124 to rotate counter clockwise by 90°, aligning the flange 940 with channel 938 of the anchor 122. Consequently, the key 900 is aligned opposite flange 940 relative to the orienting member 124. At this point, the orienting member 124 has positioned the system in place to form the lateral well 136 in FIG. 1. Ordinarily, the face 138 of the diverter 128 in FIG. 1 is aligned with the key 900 using the multilateral connection described in reference to FIG. 3, to form the first lateral well. Alternatively, the face 138 of the diverter 128 in FIG. 1 may be laterally offset from the key 900 using the multilateral connection described in reference to FIG. 3 for initial orientation of the system and formation of the first lateral well. In either case, the lateral position of the face 138 of the diverter 128 in FIG. 1 may be recorded using the multilateral connection described in reference to FIG. 3 relative to the lateral reference point or key 900 for initial orientation of the system and formation of the first lateral well.

For example, the position of the face 138 of the diverter 128 used to create lateral well 136 in FIG. 1 is recorded relative to the lateral reference point or key 900 and rotated using the multilateral connection to a new lateral position to form the lateral well 212 in FIG. 2. Rotation of the multilateral connection to a new position can be quickly and efficiently performed and the initial position of the face 138 of the diverter 128 recorded, upon removal of the system from the common well bore 112.

In FIG. 11, the orienting member 124 is fully seated within the anchor 122 as shown by contact between the shoulder 942 of the orienting member 124 and seat 922 of the anchor 122. At this position, the orienting member 124 is both aligned as described in reference to FIG. 10 and secured to prevent rotational movement of the orienting member 124 during formation of the lateral well. Rotation of the orienting member 124 is prevented by the flange 940 positioned within channel 938 of the anchor 122 as shown in FIG. 12. Thus, rotation of the orienting member 124 is precluded during formation of the lateral well, however, may be easily removed upon completion of the lateral well. Additionally, the key 900 is fully engaged within channel 934 of the muleshoe 910 at this position as shown in FIG. 13. The stop 936 is positioned at a distal end of the channel 934 such that when the key 900 contacts the stop 936, the flange 940 should be fully engaged within the channel 938 of the anchor 122 and the orienting member 124 firmly engaged with the seat 922 of the anchor 122.

In operation of the system 100 as described in reference to FIG. 1, the anchor 122 is lowered into the common well bore 112 using the drill string 132, and a directional survey is performed to establish the predetermined position of the anchor 122. Once the directional survey is complete, the anchor 122 is set at its predetermined position using slips 130 which are forced against casing 118 in a conventional manner. Accordingly, the bottom of the anchor 122 defines the longitudinal reference point 134 and the key 900 as described in reference to FIG. 9 defines the lateral reference point.

Once the anchor 122 is set at its predetermined position, the system, comprising the diverter 128, extension member 126, and orienting member 124, is lowered into the common well bore 112 using the drill string 132 which is operatively and releasably connected to the diverter 128. Prior to lowering the system 100 into the common well bore 112, the face 138 of the diverter 128 is positioned at a first lateral position and a first longitudinal position. The first longitudinal position defined by the distance between the longitudinal reference point 134 and the diverter 128 which depends upon the number of segments comprising the extension member 126. The first lateral position is defined as the position of the face 138 of the diverter 128 relative to the lateral reference point or key 900. The first longitudinal position and first lateral position are recorded before lowering the system 100 into the common well bore 112 for creating lateral well 136. The first longitudinal position may be measured and recorded by knowing the length of the anchor 122 and measuring the length of the components comprising the system 100 between the anchor 122 and the diverter 128 which are then added to determine the distance between the longitudinal reference point 134 and the diverter 128. The first lateral position may be measured and recorded by knowing the position of the face 138 of the diverter 128 relative to the lateral reference point.

After the system 100 is made up and the first lateral position and first longitudinal position are recorded, the system 100 may then be lowered into the common well bore 112 until the orienting member 124 is slidably and fully engaged within the anchor 122 for initial orientation of the system 100. Alignment of segments 156, 158 and 160 comprising the extension member 126 and the face 138 of the diverter 128 is performed by using a combination of the unilateral and multilateral connections. The unilateral connections maintain alignment between the orienting member 124 and the face 138 of the diverter 128 in a single lateral direction. The multilateral connection enables the alignment maintained by the unilateral connections to be adjusted in preselected increments as described in reference to FIGS. 4 and 5. Thus, if the system 100 were made up where the connection 160 included the multilateral connection, alignment between the orienting member 124 and segments 158 and 160 could be maintained in a single lateral direction, whereas segment 156 and the diverter 128 may be rotated to different lateral positions prior to makeup of the system 100.

Once the orienting member 124 is fully engaged within the anchor 122, the other anchor 164 is set, thus, securing the segment 156 and diverter 128. The drill string 132 is then disconnected from the diverter 128 by compressing the system and lowered until the probe 148 engages the face 138 of the diverter 128 causing the drill string 132 and probe 140 to bore through the casing 118, cement liner 120 and/or wall of the common well bore 112 into the adjacent formation 116 to form the lateral well 136 as shown in FIG. 1. Although creating the lateral well 136 may be performed in a single run in some applications, in most applications the lateral well is created in two separate runs because two different probes are used to mill an opening or "window" in casing 118 and drill through the formation 116. As a result, the probe used to mill must be removed at the surface and replaced with a probe used to drill, thus requiring two separate runs to complete a lateral well.

Once the lateral well 136 is formed in the formation 116, the drill string 132 and probe 140 are removed from the common well bore 112 and the orienting member 124, extension member 126 and diverter 128 are retrieved from the common well bore 112. After retrieval and removal of the system 100 from the common well bore 112, a new system 200 as described in reference to FIG. 2 may be constructed comprising the orienting member 124, a new extension member 216, and the diverter 128. The extension member 126 in FIG. 1 may be adjusted to construct the extension member 216 in FIG. 2 by simply removing one or more of the segments 156, 158 or 160. Alternatively, if the extension member comprises a single segment (not shown), the length of the extension member may be adjusted by removing the extension member and replacing it with another extension member having a different length or releasably connecting another extension member to the existing extension member. Prior to makeup of the extension member 216, the face 138 of the diverter 128 is positioned at a second lateral position relative to the lateral reference point and a second longitudinal position relative to the longitudinal reference point 134 in the same manner as described in reference to the operation of positioning the face 138 of the diverter 128 in FIG. 1. The second lateral position and second longitudinal position are thus recorded and the system 200 made up before lowing the system into the common well bore 112.

After makeup of the system 200, the system 200 is lowered into the common well bore 112 until the orienting member is engaged within the anchor 122 as described in reference to the operation of the system 100 in FIG. 1. At this point, the face 138 of the diverter 128 is in the second lateral position and second longitudinal position. The drill string 132 and probe 140 are disconnected from the diverter 128 by compressing the system. The probe 140 then engages the face 138 of the diverter 128 causing the boring bit 142 to bore through the casing 118, cement liner 120, and/or wall of the common well bore 112 into the adjacent formation 214 to form the lateral well 212 in the same manner as described in reference to forming the lateral well 136 in FIG. 1.

Accordingly, the operation of the system as described in reference to FIGS. 1 and 2, enables lateral orientation of the diverter 128 at multiple positions relative to the lateral reference point 900, and positioning the diverter 128 at multiple longitudinal positions relative to the longitudinal reference point 134. Moreover, the system enables the creation of multiple lateral wells as thus described within the common well bore 112 after the anchor 122 is secured. Because the system of the present invention comprises many conventional or standard components, the system costs less to manufacture than many alternative systems which require specially designed casing and other components manufactured in accordance with the specific requirements of the particular site and common well bore. Additionally, the present system and use thereof may be employed in new and existing well bores using the same components which substantially reduces the costs as compared to other systems which are manufactured in accordance with a particular well bore's characteristics and specifications.

As a result of utilizing non-threaded connections of the type describe herein as the unilateral and multilateral connections, the system may be reconstructed to enter a particular lateral well if necessary. For example, if the lateral well 136 in FIG. 1 required reentry for completion operations, then the same process as described in reference to formation of the lateral well 136 in FIG. 1 is performed using the probe 140 or another probe as desired. Likewise, the lateral well 212 as described in reference to FIG. 2 may be reentered according to the same procedure. In either case, the lateral well is relocated for reentry by reconstructing the system which may be done using the same components aligned in the same manner to exactly locate and reenter the lateral well according to the precise depth and lateral orientation. Reentry of the lateral well in this manner may only be accomplished using the components as described herein comprising the system of the present invention. In particular, the unilateral and multilateral connections permit alignment and recording of the lateral and longitudinal position of the face of the diverter in a manner that is cost-efficient, effective and more accurate than conventional threaded connections which often promote misalignment between the components comprising a system each time the threaded connection is made up, causing the need for expensive directional surveys.

Although the objects and advantages of the present invention have been described in detail, those skilled in the art should understand that they can make various changes, substitutions, and alterations herein without departing from the spirit and scope of the present invention in its broadest form.

What is claimed is:

1. A system for creating multiple lateral wells through a wall of a common well bore using a probe, comprising:

(a) an anchor secured within the common well bore at a predetermined position, the anchor including a longitudinal reference point and a lateral reference point;

(b) an orienting member slidably engaged within the anchor for initial orientation of the system relative to the lateral reference point;

(c) an extension member, the extension member having a first end releasably connected to the orienting member and a second end;

(d) a diverter releasably connected to the second end of the extension member, the diverter including a face for directing the probe toward the wall of the common well bore upon contact with the diverter; and (e) the system enabling lateral orientation of the diverter at multiple positions relative to the lateral reference point, positioning the diverter at multiple longitudinal positions relative to the longitudinal reference point, and selective reentry of each of the respective multiple lateral wells created.

2. The system of claim 1, wherein the connection of the first end and second end of the extension member to the respective orienting member and diverter restricts rotational and translational movement upon makeup, each connection maintaining alignment between the first end and second end of the extension member and the respective orienting member and diverter in a single direction.

3. The system of claim 2, wherein the extension member includes a plurality of segments for positioning the diverter at multiple longitudinal positions, each segment being releasably connected to another respective segment, each connection restricting rotational and translational movement upon makeup.

4. The system of claim 3, wherein a connection between the plurality of segments enables alignment between the respectively connected segments in multiple directions, a remainder of the connections maintaining alignment between the respectively connected plurality of segments in a single direction.

5. The system of claim 4, wherein one of the plurality of segments closest to the diverter includes another anchor secured within the common well bore for stabilizing the diverter.

6. The system of claim 5, wherein the anchor and the another anchor include packers.

7. The system of claim 1, wherein the connection of the first end and second end of the extension member to the respective orienting member and diverter restricts rotational and translational movement upon makeup, one connection enabling alignment between the extension member and the respective orienting member and diverter in multiple directions, another connection maintaining alignment between the extension member and the respective orienting member and diverter in a single direction.

8. The system of claim 7, wherein the extension member includes a plurality of segments for positioning the diverter at multiple longitudinal positions, each segment being releasably connected to another respective segment, each connection restricting rotational and translational movement upon makeup.

9. The system of claim 8, wherein each connection between the plurality of segments maintains alignment between the plurality of segments in a single direction.

10. The system of claim 1, wherein the orienting member includes a muleshoe and stinger assembly.

11. The system of claim 1, wherein the diverter includes a whipstock.

12. The system of claim 1, wherein the probe includes a boring tool.

13. The system of claim 1, wherein the lateral reference point includes a key attached to the anchor.

14. The system of claim 13, wherein the orienting member includes a channel for receipt of the key, engagement of the key within the channel enabling the initial orientation of the system.

15. The system of claim 1, wherein the orienting member includes a flange.

16. The system of claim 15, wherein the anchor includes a channel for receipt of the flange, engagement of the flange within the channel preventing rotational movement of the orienting member.

17. The system of claim 1, wherein the face of the diverter is angled.

18. The system of claim 1, wherein the face of the diverter is arcuate.

19. A method for creating multiple lateral wells through a wall of a common well bore using a system of releasably connected components comprising an orienting member, an extension member, a diverter and a probe, the method comprising the steps of:

(a) securing an anchor within the common well bore at a predetermined position, the anchor including a longitudinal reference point and a lateral reference point;

(b) lowering the system into the common well bore until the orienting member slidably engages the anchor for initial orientation of the system relative to the lateral reference point, the diverter being positioned at a first lateral position and a first longitudinal position;

(c) releasing the probe from the diverter, the diverter including a face for directing the probe toward the wall of the common well bore upon release of the probe from the diverter; and (d) creating a lateral well through the wall of the common well bore using the probe, the system enabling lateral orientation of the diverter at multiple positions relative to the lateral reference point, positioning the diverter at multiple longitudinal positions relative to the longitudinal reference point, and selective reentry of each of the respective multiple lateral wells created.

20. The method of claim 19, further comprising the step of performing a directional survey for determining the predetermined position of the anchor.

21. The system of claim 19, wherein the location of the lateral well is determined by the first lateral position and the first longitudinal position, the first lateral position aligned with the first lateral reference point and the first longitudinal position located a predetermined distance from the first longitudinal reference point.

22. The method of claim 19, wherein the step of securing the anchor within the common well bore is performed by a plurality of slips.

23. The method of claim 19, wherein the extension member includes a plurality of segments for positioning the diverter at multiple longitudinal positions, each segment being releasably connected to another respective segment, each connection restricting rotational and translational movement upon makeup.

24. The method of claim 23, wherein one of the plurality of segments closest to the diverter includes another anchor for stabilizing the diverter.

25. The method of claim 24, further comprising the step of securing the another anchor within the common well bore below the diverter.

26. The method of claim 19, further comprising the steps of:

(a) removing the system from the common well bore upon completion of the lateral well;

(b) adjusting a length of the extension member;

(c) positioning the diverter at a second lateral position relative to the lateral reference point;

(d) lowering the system into the common well bore until the orienting member slidably engages the anchor, the diverter being positioned at a second longitudinal position relative to the longitudinal reference point;

(e) releasing the probe from the diverter; and (f) creating another lateral well through the wall of the common well bore using the probe.

27. The method of claim 26, wherein the step of adjusting a length of the extension member includes removing the extension member and replacing it with another extension member having a different length than the extension member.

28. The method of claim 26, wherein the step of adjusting a length of the extension member includes releasably connecting another extension member to the extension member.

29. The method of claim 26, wherein the extension member includes a plurality of releasably connected segments, the step of adjusting a length of the extension member comprising removal of one of the plurality of segments.

30. The method of claim 26, wherein the step of removing the system upon completion of the lateral well comprises:

(a) removing the probe from the common well bore with a drill string connected to the probe; and (b) retrieving the orienting member, extension member and diverter from the common well bore.

31. The method of claim 26, wherein the extension member includes a first end and a second end, the first end and second end of the extension member releasably connected to the respective orienting member and diverter for restricting rotational and translational movement upon makeup, one connection enabling alignment between the extension member and the respective orienting member and diverter in multiple directions, another connection maintaining alignment between the extension member and the respective orienting member and diverter in a single direction.

32. The method of claim 26, wherein reentry of the another lateral well comprises the steps of:

(a) replacing the probe with another probe, the diverter releasably connected to the another probe;

(b) lowering the system into the common well bore until the orienting member slidably engages the anchor, the diverter positioned at the second lateral position and the second longitudinal position; and (c) releasing the another probe from the diverter for reentry of the another lateral well.

33. The method of claim 19, wherein reentry of the lateral well comprises the steps of:

(a) replacing the probe with another probe, the diverter releasably connected to the another probe;

(b) lowering the system into the common well bore until the orienting member slidably engages the anchor, the diverter positioned at the first lateral position and the first longitudinal position; and (c) releasing the another probe from the diverter for reentry of the lateral well.

34. The method of claim 19, wherein the step of releasing the probe from the diverter is performed by compressing the system, the probe being released from the diverter upon compression of the system.

35. The method of claim 19, wherein the diverter includes an angled face, the step of creating the lateral well comprising one of the steps of milling through the wall of the common well bore and drilling into an adjacent formation.

36. The method of claim 19, wherein the step of creating the lateral well is performed in a single run.

37. The method of claim 19, wherein the lateral reference point includes a key attached to the anchor.

38. The method of claim 37, wherein the orienting member includes a channel for receipt of the key, engagement of the key within the channel enabling initial orientation of the system.

39. The method of claim 19, wherein the orienting member includes a flange.

40. The method of claim 39, wherein the anchor includes a channel for receipt of the flange, engagement of the flange within the channel preventing rotational movement of the orienting member.

* * * * *

UNITED STATES PATENT AND TRADEMARK OFFICE

CERTIFICATE OF CORRECTION

PATENT NO. : 6,427,777 B1
DATED : August 6, 2002
INVENTOR(S) : Robert C. Schick

It is certified that error appears in the above-identified patent and that said Letters Patent is hereby corrected as shown below:

Column 7,
Lines 6 and 7, replace “112” with -- 122 --.
Line 56, add -- or -- after “DYNETOR®”.

Column 12,
Line 12, replace “describe” with -- described --.
Line 31, add -- is -- between “position” and “defined”.
Line 63, replace “160” with -- 161 --.

Column 13,
Line 5, replace “148” with -- 140 --.

Signed and Sealed this

Twenty-sixth Day of November, 2002

*Attest:*

*Attesting Officer*

JAMES E. ROGAN
*Director of the United States Patent and Trademark Office*